United States Patent [19]

Green et al.

[11] 4,013,285

[45] Mar. 22, 1977

[54] COPYING MACHINE

[75] Inventors: Mitchell V. Green, Natick, Mass.; Yukio Akita, Chiba; Mitsuji Tachikawa, Tokyo, both of Japan

[73] Assignee: Copyer Co., Ltd., Tokyo, Japan

[22] Filed: Mar. 5, 1976

[21] Appl. No.: 664,180

[30] Foreign Application Priority Data

Mar. 6, 1975 Japan ..... 50-30262[U]

[52] U.S. Cl. ..... 271/261

[51] Int. Cl.[2] ..... B65H 7/08

[58] Field of Search ..... 271/258, 261, 174

[56] References Cited

UNITED STATES PATENTS

| | | | |
|---|---|---|---|
| 908,412 | 12/1908 | Kandle | 271/261 |
| 923,658 | 6/1909 | Kandle | 271/261 |
| 2,072,235 | 3/1937 | Wormser | 271/261 |
| 3,883,134 | 5/1975 | Shinaki | 272/261 |
| 3,923,298 | 12/1975 | Ishida | 271/174 |

*Primary Examiner*—Richard A. Schacher
*Attorney, Agent, or Firm*—Cushman, Darby & Cushman

[57] ABSTRACT

A copying apparatus includes a copy paper-separating device which separates a copying paper from a rotary drum by engaging the projecting portion from the corresponding end face of the rotary drum by a prescribed width, and a detecting device for detecting whether the projecting portion of the copying paper has a prescribed width, before the copying paper reaches the rotary drum.

6 Claims, 3 Drawing Figures

COPYING MACHINE

BACKGROUND OF THE INVENTION

This invention relates to a copying apparatus equipped with a paper separating mechanism for forcefully taking off a sheet of copy paper from a rotary drum.

An electronic or static copying apparatus is generally provided with a rotary drum, the peripheral surface of which is fitted with a layer of photosensitized material, thereby causing a static image formed on said layer of photosensitized material to be transferred to a sheet of copy paper. For transcription of the static image, the copy paper is statically adhered to the peripheral layer of photosensitized material, making it necessary to provide a paper-separating device capable of forcefully and reliably taking off the copy paper from the rotary drum after completion of transcription. If the paper-separating device does not work satisfactorily, then there arise various difficulties that the copy paper is inseparably wound about the rotary drum, drawn into a cleaner box disposed near the periphery of the rotary drum, namely giving rise to the so-called jammed condition of the copying apparatus due to blocking by the copy paper or, when thus pulled into the cleaner box, rubs the layer of photosensitized material formed on the peripheral wall of the rotary drum with the resultant damage of said layer.

A recently proposed device of simple arrangement designed for reliable separating of a sheet of copy paper from the rotary drum is the type which feeds a sheet of copy paper with one lateral edge portion of said copy paper made to project outward from the corresponding end face of the rotary drum by a certain width, and, after completion of transcription of a static image to the copy paper, engages an arm with the projecting edge portion of the copy paper to effect its removal from the rotary drum. With a copying apparatus equipped with the above-mentioned type of paper-separating device, no difficulty arises where the copy paper is set at an exactly desired position on a paper feeder. Where, however, the copy paper is displaced from the prescribed position, then there occur various drawbacks that the lateral edge portion of the copy paper projects from the corresponding end face of the rotary drum to a smaller extent than desired, or sometimes does not project therefrom at all, failing to attain the normal operation of the copying apparatus, and consequently leading to its jammed condition and the damage of the surface of the photosensitive layer formed on the periphery of the rotary drum.

SUMMARY OF THE INVENTION

It is accordingly the object of this invention to provide a copying apparatus equipped with a paper-separating mechanism designed to feed a sheet of copy paper with one lateral edge portion of the copy paper made to project outward from the corresponding end face of the rotary drum by a certain width, and after completion of transcription of a static image to the copy paper, engage an arm with the projecting edge portion of the copy paper to effect its removal from the rotary drum, which further comprises an additional device for detecting whether the copy paper and rotary drum have such relative positions as admit of the normal operation of the paper-separating mechanism and, when the copy paper and rotary drum do not have such relative positions as attain said normal operation, then automatically preventing a sheet of copy paper from being brought to the rotary drum, thereby suppressing the occurrence of the jammed condition of the copying apparatus and the damage of the surface of the photosensitive layer.

DESCRIPTION OF THE PREFERRED EMBODIMENT

Figure 1:
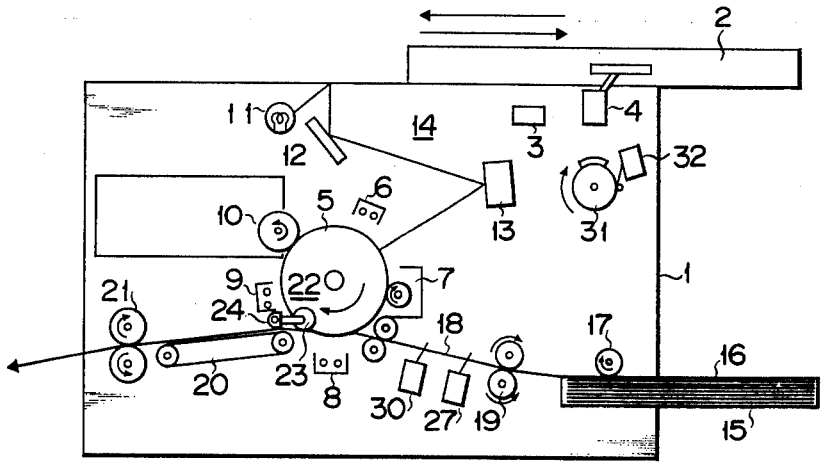
FIG. 1 schematically illustrates the general setup of a copying apparatus embodying this invention.
Figure 2:
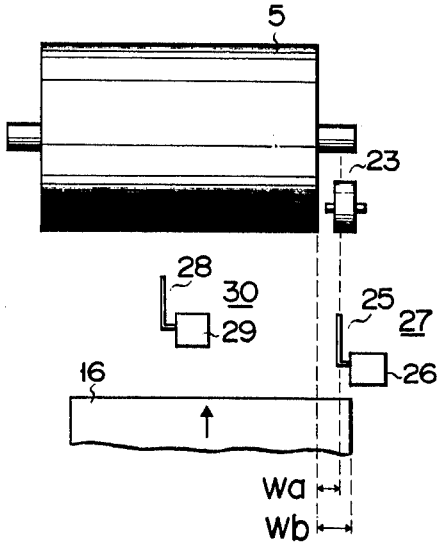
FIG. 2 presents the relative positions of the rotary drum, copy paper and switch means used in the copying apparatus of FIG. 1.

Referring to FIG. 1, a manuscript table 2 is reciprocatively mounted on the upper surface of the body or housing 1 of a copying apparatus. When a print switch 3 is actuated by a manuscript table-driving device (not shown), the manuscript table 2 reciprocates in the directions of the indicated arrows. The moved position of the manuscript table 2 is detected, as is well known, by a timing switch 4, for example, a microswitch for control of the later-described copy paper-transporting means.

The body 1 of the copying machine contains a cylindrical statically copying rotary drum 5, whose peripheral surface is fitted with a layer of photosensitized material. Arranged around the periphery of the rotary drum 5 are a charging electrode 6, developing device 7, transcription electrode 8, discharging electrode 9 and cleaner mechanism 10 in the order mentioned as counted in the rotating direction of the drum 5.

The body 1 of the copying apparatus further contains a light exposure device 14 which projects a light from a light source 11 on the surface of a manuscript placed on the manuscript table 2, conducts a light reflected from said surface through a mirror 12 and in-mirror lens 13 and focuses said reflected light on the photosensitive layer now charged by the charging electrode 6.

The body 1 of the copying apparatus also contains a copy paper case 15 in which a plurality of sheets of copy paper 16 are to be received in the superposed form. The sheets of copy paper 16 are delivered to a copy paper-transporting passage 18 one after another by paper-transporting means or roll 17. The copy paper-transporting passage 18 is provided with paper-feeding rolls 19 to guide a sheet of copy paper from the transporting roll 17 to the rotary drum 5. The copy paper-transporting passage 18 is also provided with a copy paper-discharging belt 20 to draw out a sheet of copy paper on which a static image has been transcribed by the rotary drum 5. A fixing device 21 is disposed near the terminal point of the copy paper-transporting passage 18, namely, the outlet of the body 1 of the copying apparatus to fix a static image transcribed on the copy paper 16.

A paper separating device 22 is positioned close to one end face of the rotary drum 5. This paper-separating device 22 comprises a paper-removing roll 23 disposed at a slight distance Wa from one end face of the rotary drum 5 and a guide arm 24 swingable along the copy paper-transporting passage 18. One end of said arm 24 rotatably supports the paper-separating roll 23 and the other end thereof is pivotally fitted to a proper support. A sheet of copy paper 16 is supplied to the rotary drum 5 with one lateral edge portion of the copy paper 16 made to project outward from the corresponding end face of the rotary drum 5. When the projecting end portion of the copy paper 16 engages the paper-separating roll 23, the copy paper 16 is easily separated from the rotary drum 5. This type of paper-separating mechanism is already known, for example, by the U.S. Pat. No. 3,923,298. To effect the separation of the copy paper 16 from the rotary drum 5, the copy paper-transporting roll 17 and copy paper-feeding rolls 19 are designed to feed the copy paper 16 to the rotary drum 5 with one lateral edge portion of said copy paper 16 made to project outward from the corresponding end face of the rotary drum 5 by a prescribed width Wb in order to match the operation of the paper-separating device 22. All the members associated with the feeding of copy paper 16 to the rotary drum 5 are so designed as to make the width W*b* of the projecting portion of the copy paper 16 slightly larger than a distance Wa between the paper-separating roll 23 and rotary drum 5.

The copy paper-transporting passage 18 further has a projecting width-detecting switch 27 and moved position-detecting switch 30 which are disposed between the copy paper-transporting roll 17 and rotary drum 5. The projecting width-detecting switch 27 is formed of a microswitch 26 whose actuator 25 is disposed at a distance W*a* from the end face of the rotary drum 5 like the copy paper-separating roll 23. The projecting width-detecting switch 27 is designed to detect whether the extent to which one lateral edge portion of the copy paper 16 projects outward from the corresponding end face of the rotary drum 5 exceeds the prescribed width W*a*. The moved position-detecting switch 30 is formed of a microswitch 29 wose actuator 28 is so positioned as to face the substantially central part of the rotary drum 5, thereby detecting whether the forward end of the copy paper 16 has been brought immediately in front of the rotary drum 5.

The body 1 of the copying apparatus is provided with a cam 31 operating jointly with the reciprocation of the manuscript table 2. When the manuscript table 2 is brought to a prescribed position, a paper transportation controlling switch 32 is actuated by the cam 31. As the result, the copy paper-transporting roll 17 is put into operation, causing a plurality of sheets of copy paper 16 received in the copy paper case 15 to be delivered to the copy paper-transporting passage 18 one after another.

Figure 3:
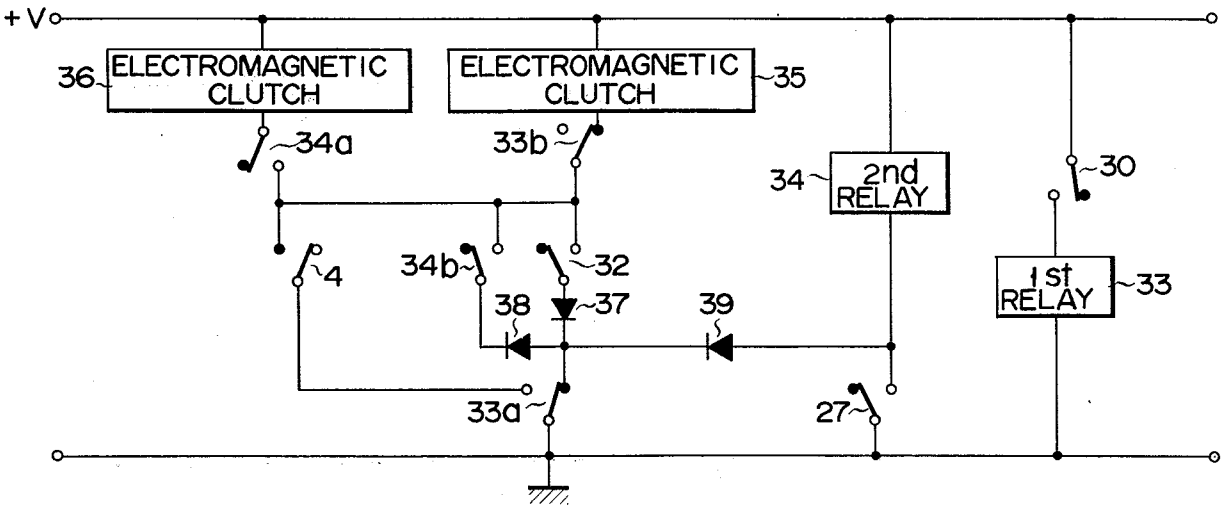
FIG. 3 indicates a circuit arrangement for operation of the coying apparatus of FIG. 1.

There will now be described by reference to FIG. 3 a circuit arrangement for the operation of the subject copying machine provided with the projecting width-detecting switch 27 and moved position-detecting switch 30.

Both detecting switches 27, 30 are of the normally open type and are closed when a sheet of copy paper 16 touches the actuators 25, 28 of these switches. The moved position-detecting switch 30 is connected to a power source through a first control relay 33, and the projecting width-detecting switch 27 is connected to the power source through a second control relay 34. The copy paper-transporting roll 17 is driven by a motor (not shown). A copy paper-transporting electromagnetic clutch 35 for controlling the operative connection between the above-mentioned members is connected to a power source through the normally closed contact of a second changeover switch 33*b* of a first control relay 33, and a series circuit consisting of the open type copy paper transportation-controlling switch 32, a diode 37 with its anode connected to the switch 32 and the normally closed side of a first changeover switch 33*a* of the first control relay 33.

The aforesaid driving motor (not shown) drives the copy paper-feeding rolls 19 through an electromagnetic clutch 36 by the known process. This electromagnetic clutch 36 is connected to the power source through the normally open side of a first changeover switch 34*a* of the second control relay 34 and the above-mentioned series circuit. Connected parallel with said series circuit is another series circuit consisting of the normally closed side of the timing switch 4 and the normally open side of the first changeover switch 33*a* of the first control relay 33. A series circuit consisting of the normally open side of a second changeover switch 34*b* of the second control relay 34 and a diode 38 is connected parallel with the copy paper transportation-controlling switch 32 and diode 37. There is provided another diode 39 whose anode is connected between the second control relay 34 and switch 27 and whose cathode is connected to the anode of the diode 38, namely the cathode of the first mentioned diode 37. These three diodes 37, 38, 39 prevent current from being conducted in any other direction than prescribed.

Where, with a copying apparatus of this invention arranged as described above, the manuscript table 2 is returned to a starting position as shown in FIG. 1, then the timing switch 4 detects said position of the manuscript table 2 and is put into operation, that is, the normally open contact of the timing switch 4 is closed as shown in FIG. 1. Where, under this condition, current is introduced, then the second control relay 34 is excited through the diode 39 and the normally closed side of the first changeover switch 33*a* of the first control relay 33.

When the print switch 3 is operated for reciprocation of the manuscript table 2, the cam 31 rotates to close the copy paper transportation-controlling switch 32. At this time, the copy paper-transporting electromagnetic clutch 35 and copy paper-feeding electromagnetic clutch 36 are excited to operate the copy paper-transporting roll 17 and copy paper-feeding rolls 19, thus causing one of the superposed sheets of copy paper 16 received in the copy paper case 15 to be delivered to the copy paper-transporting passage 18 and then to the rotary drum 5.

Where, under this condition, the copy paper 16 has been brought to a prescribed position, namely, to the extent that the width W*b* by which one lateral edge portion of the copy paper 16 projects from the corresponding end face of the rotary drum 5 is made larger than the distance W*a* between the paper-separating roll 23 and the rotary drum 5, then the projecting width-detecting switch 27 is closed upon excitation by the copy paper 16 and thereafter the moved position-detecting switch 30 is closed. As the result, the first control relay 33 is excited to operate its changeover switches 33*a*, 33*b*, demagnetizing the copy paper transporting and feeding electromagnetic clutches 35, 36, with the resultant stoppage of the copy paper-transporting roll 17 and copy paper-feeding rolls 19. The timing switch 4 is again closed after detecting a length of time required for the manuscript table 2 to return to the prescribed copy-starting position. As the result, the copy paper-feeding electromagnetic clutch 36 alone is temporarily brought to rest for timing and thereafter is again excited. The copy paper-feeding rolls 19 are again put into operation to feed the copy paper 16 to the rotary drum 5. A static image already impressed on a film of sensitized material mounted on the peripheral surface of the rotary drum 5 is transcribed on the copy paper 16, which is later forcefully separated from the rotary drum 5 by means of the paper-separating device 22, and drawn out of the housing 1 through the fixing device 21 by means of the copy paper-discharging belt 20. Since, in this case, one lateral edge portion of the copy paper 16 projects from the corresponding end face of the rotary drum 5 by the prescribed width W*b* as naturally expected from the above-mentioned operation, the paper-separating device 22 is actuated under normal condition, preventing the copy paper 16 from being inseparably wound about the rotary drum 5.

Conversely where the copy paper 16 is going to be brought to the rotary drum 5 in the state displaced from the prescribed position, for example, under the condition where the width W*b* by which one lateral edge portion of the copy paper 10 projects from the corresponding end face of the rotary drum 5 is smaller than the distance W*a* between the copy paper-separating roll 23 and the rotary drum 5, then the copy paper 16 passes the projecting width-detecting switch 27 without energizing it, but only actuates the moved position-detecting switch 30. When this switch 30 is energized, the electromagnetic clutches 35, 36 are demagnetized as in normal operation to stop the copy paper-transporting roll 17 and copy paper-feeding rolls 19. Though, in this case, the timing switch 4 is closed, the projecting width-detecting switch 27 is not actuated in spite of the excitation of the first control relay 33, thus demagnetizing the second control relay 34. Unlike the case of normal operation, the copy paper-feeding clutch 36 is not excited, nor actuate the copy paper-feeding rolls 19. Consequently, the copy paper 16 is brought to rest immmediately before the rotary drum 5 and is prevented from being fed thereto. In the above-mentioned abnormal condition, too, therefore, the copying apparatus is saved from the difficulties which might occur if the copy paper 16 was, forcefully fed to the rotary drum in the displaced state, for example, the undesirable possibility of the copy paper 16 being caught on the rotary drum 5.

In the above-mentioned abnormal case, the copy paper 16 is not drawn out of the copying machine. If an operator noticing said abnormality cuts off power supply and takes out a sheet of copy paper stopped in front of the rotary drum 5 and introduces current again, then the copying apparatus will be restored to a normal condition. If an operator should supply however by mistake without removing the nonprocessed sheet of copy paper after once shutting off a power source and depresses the print switch, said nonprocessed copy paper still continues to energize the moved position-detecting switch 30, causing the first control relay 33 to be excited upon power supply. Since, under this condition, the electromagnetic clutches 35, 36 are prevented from being actuated, a fresh sheet of copy paper is little likely to be brought to the rotary drum 5, thereby enabling the copying apparatus to be always operated under normal condition.

What we claim is:

1. In a copying apparatus comprising a copy paper-transporting device, a statically copying rotary drum whose peripheral surface is fitted with a photo-sensitive layer, a copy paper-feeding device for carrying the copy paper delivered from the copy paper-transporting device to the rotary drum, and a copy paper-separating device disposed near one end face of the rotary drum to guide one lateral edge portion of the copy paper projecting outward from the corresponding end face of the rotary drum by a prescribed width in a direction in which said copy paper can be detached from the rotary drum, thereby separating the copy paper statically adhered to the photo-sensitive layer mounted on the peripheral wall of the rotary drum, the improvement which further comprises a moved position-detecting switch for detecting the arrival of the forward end of the copy paper immediately in front of the rotary drum; a projecting width-detecting switch for determining whether one lateral edge portion of the copy paper projects outward from the corresponding end face of the rotary drum by a prescribed width, before the moved position of the copy paper is detected by said moved position-detecting switch; and means for restricting the operation of the copy paper-feeding device to prevent the copy paper from being brought to the rotary drum, in case the projecting width-detecting switch does not detect the projecting width of one lateral edge portion of the copy paper, but the moved position-detecting switch along detects the moved position of the copy paper.

2. The copying apparatus according to claim 1, which further comprises means for preventing the copy paper-transporting device from being operated again when the copy paper does not occupy a prescribed position.

3. The coying apparatus according to claim 1, wherein the device for detecting the moved position of the copy paper is actuated by the central portion of the copy paper; and the device for detecting the width by which one lateral edge portion of the copy paper projects outward from the corresponding end face of the rotary drum is so positioned as to be operated by said one lateral edge portion of the copy paper.

4. In a copying apparatus as in claim 1, wherein said restriction means includes circuit means connected to said position-detecting and width-detecting switches for producing a rstriction output signal when said position-detecting switch detects the arrival of a copy paper and said width detecting switch does not detect said lateral edge portion, wherein said paper feeding device includes paper feeding roll motor means for driving said roll, and an electromagnetic clutch for coupling said motor means to said roll and said restriction means includes means connecting said clutch to said circuit means for disabling said clutch when said restriction signal is produced.

5. In a copying apparatus as in claim 4, wherein said paper feeding device includes a second paper feeding roll for removing a sheet of paper from a stack and delivering the removed sheet to the first roll, second motor means for driving said second roll, and a second electromagnetic clutch for coupling said second motor means to said second roll and said restriction means includes means connecting said second clutch to said circuit means for disabling said second clutch when said restriction signal is produced.

6. In a copying apparatus as in claim 5 wherein said circuit means comprises a first relay serially connected to an electric source via said position-detecting switch and having first and second controlled switches, a second relay connected to said source via said width-detecting switches and having third and fourth controlled switches, a first diode connected in series with said first controlled switch to form a current path in parallel with said width-detecting switch, a second diode serially connected to said first controlled switch and said second and third controlled switches for forming a current path through said second and first clutches, respectively, and a third diode serially connected to said fourth controlled switch for forming a parallel connection with said second diode.

* * * * *